US006271140B1

(12) United States Patent
Chang

(10) Patent No.: US 6,271,140 B1
(45) **Date of Patent: *Aug. 7, 2001**

(54) COAXIAL DRESSING FOR CHEMICAL MECHANICAL POLISHING

(75) Inventor: Randy (C. H.) Chang, Hsinchu (TW)

(73) Assignee: Vanguard International Semiconductor Corporation, Hsin-chu (TW)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/165,001

(22) Filed: Oct. 1, 1998

(51) Int. Cl.[7] ..... H01L 21/302

(52) U.S. Cl. ..... 438/692; 438/693; 156/345; 451/287; 451/288

(58) Field of Search ..... 438/690, 691, 438/692, 693; 451/287, 288, 443, 444; 156/345

(56) References Cited

U.S. PATENT DOCUMENTS

| | | | | |
|---|---|---|---|---|
| 5,605,499 | | 2/1997 | Sugiyama et al. | 451/443 |
| 5,616,063 | | 4/1997 | Okumura et al. | 451/1 |
| 5,624,299 | | 4/1997 | Shendon | 451/28 |
| 5,664,987 | | 9/1997 | Renteln | 451/21 |
| 5,681,212 | | 10/1997 | Hayakawa et al. | 451/288 |
| 5,842,912 | * | 12/1998 | Holzapfel et al. | 451/72 |
| 5,931,725 | * | 8/1999 | Inaba et al. | 451/288 |
| 6,004,196 | * | 12/1998 | Doan et al. | 451/443 |

* cited by examiner

*Primary Examiner*—Benjamin L. Utech
*Assistant Examiner*—Kin-chan Chen
(74) *Attorney, Agent, or Firm*—George O. Saile; Stephen B. Ackerman

(57) ABSTRACT

A polishing apparatus of a semiconductor wafer by a chemical-mechanical polishing method including a polishing platen having an upper surface on which a polishing pad is attached. The polishing platen is rotated in one direction along a central axis. A plurality of coaxial polishing-dressing head assemblies each having a lower surface opposed to an upper surface of the polishing pad on the polishing platen. Each of the coaxial assemblies holds a wafer to be polished while rotating along a central axis and pressing the rotating wafers on a radial portion of the rotating polishing pad. A polishing pad dressing ring is mounted coaxially encircling each of the wafer supporting heads. The applied compression on the wafer supporting heads pushes the wafer and the coaxially mounted dressing ring against the upper surface of the polishing pad therefore polishing each wafer while dressing the polishing pad.

10 Claims, 4 Drawing Sheets

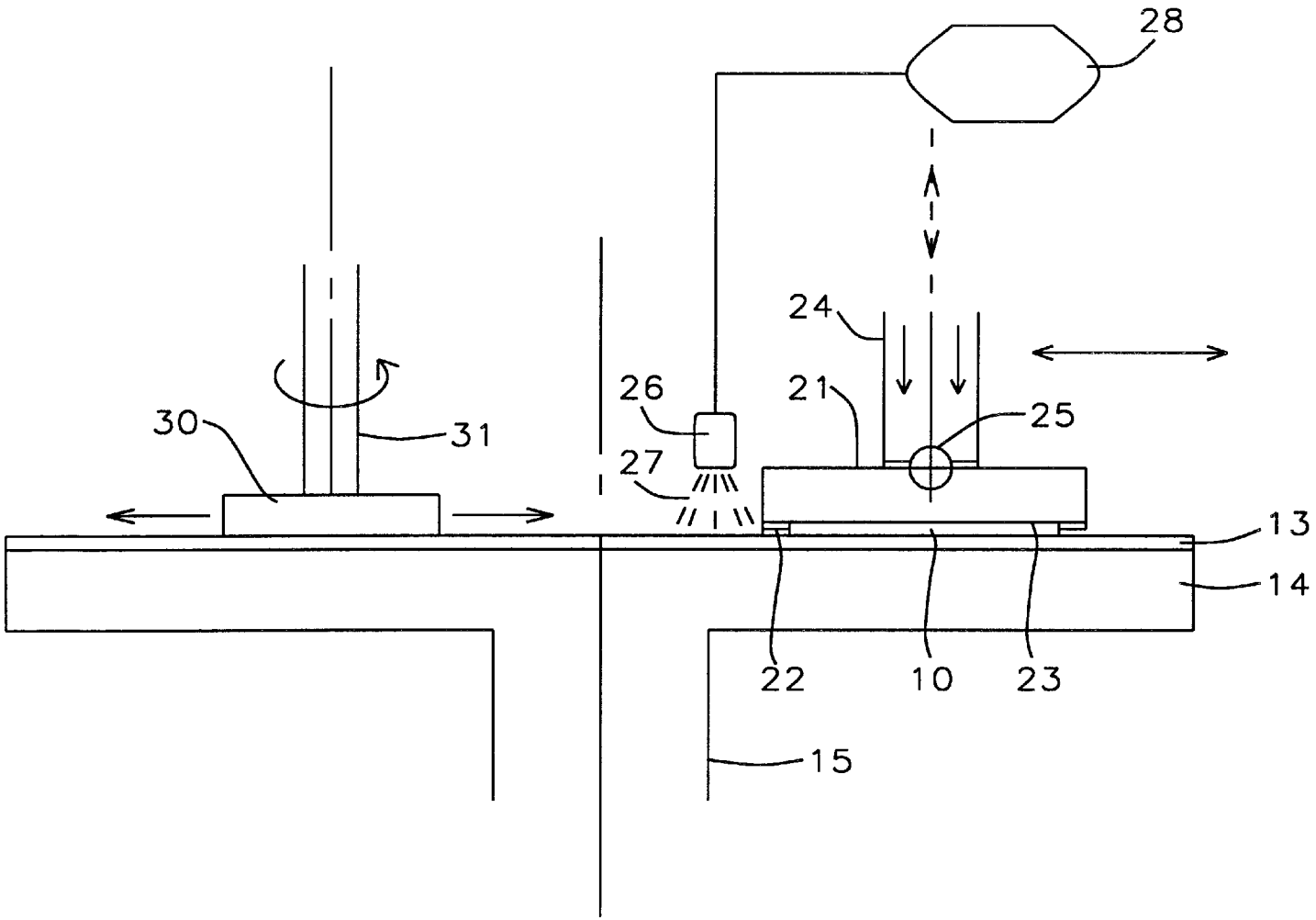
FIG. 1 – Prior Art

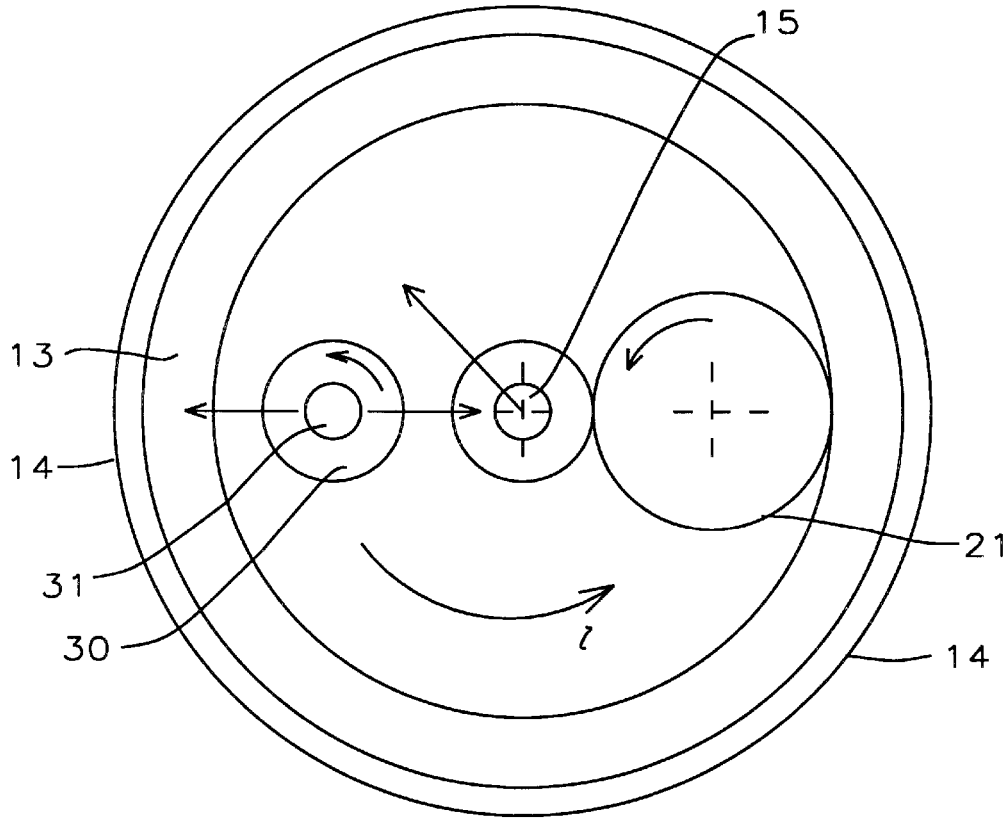
FIG. 2 – Prior Art
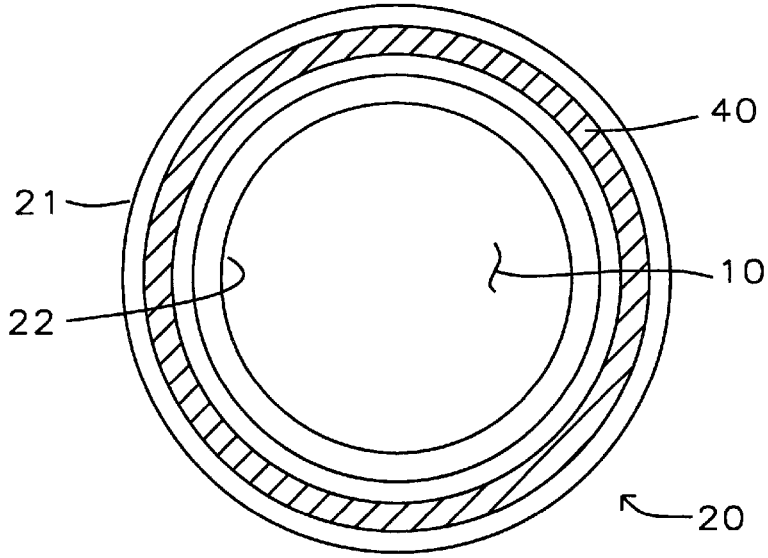
FIG. 3

COAXIAL DRESSING FOR CHEMICAL MECHANICAL POLISHING

BACKGROUND OF THE INVENTION (1) Technical Field

This invention relates generally to an apparatus and method for polishing semiconductor wafers during the manufacturing of integrated circuit, and more particularly, to methods for dressing a polishing pad during the process of chemical mechanical polishing.

(2) Description of the Prior Art

The following five documents relate to methods dealing with the dressing of chemical mechanical polishing (CMP) pads during the polishing of integrated circuits formed on semiconductor wafers.

U.S. Pat. No. 5,681,212 issued Oct. 28, 1997 to H. Hayakawa et al., shows a polish head.

U.S. Pat. No. 5,664,987 issued Sep. 9, 1997 to P. Renteln, discloses a method and apparatus to condition a polish pad using a conditioning track on the polish pad.

U.S. Pat. No. 5,624,299 issued Apr. 29, 1997 to Shendon, shows a carrier head with a polish pad and retaining ring.

U.S. Pat. No. 5,616,063 issued Apr. 1, 1997 to K. Okumura et al. shows a polishing apparatus with multiple heads.

U.S. Pat. No. 5,605,499 issued Feb. 25, 1997 to M. Suglyama et al. shows a standard chemical mechanical polishing head.

The fabrication of integrated circuits on a semiconductor wafer involves a number of steps where patterns are transferred from photolithographic photomasks onto the wafer. The photomasking processing steps opens selected areas to be exposed on the wafer for subsequent processes such as inclusion of impurities, oxidation, or etching.

During the forming of integrated circuit structures, it has become increasingly important to provide structures having multiple metallization layers due to the continuing miniaturization of the circuit elements in the structure. Each of the metal layers is typically separated from another metal layer by an insulation layer, such as an oxide layer. To enhance the quality of an overlying metallization layer, one without discontinuities of other blemishes, it is imperative to provide an underlying surface for the metallization layer that is ideally planar. The process of planarizing is now a standard process application of integrated circuit manufacturers.

Plasma, or reactive ion etching of the oxide layers having a resist planarizing medium, are conventional planarization techniques that are used to provide a smooth surface and a local planarization with a range of 1 um.

To meet the demand for larger scale integration, and more metal and oxide layers in devices and the exacting depth of focus needed for submicron lithography, a new planarization method known as chemical mechanical polishing (CMP), was developed and is presently used by most major semiconductor manufacturers. CMP planarization of a wafer involves supporting and holding the wafer against a rotating polishing pad wet with a polishing slurry and at the same time applying pressure. Unlike the conventional planarization techniques, CMP provides a substantially improved overall planarization, that is, an improvement of 2 to 3 orders of magnitude over conventional methods. Although CMP planarization is effective, one recurring problem with CMP processing is the tendency of the process to differentially polish the surface of the wafer and thereby create localized over-polished and under-polished areas across the wafer surface. Where the wafer is to be further processed, such as by photolithographic etching to create integrated circuit structures, thickness variation in the planarized layer makes it extremely difficult to meet the fine resolution tolerances required to provide high yield of functional die on a wafer.

The difficulty in controlling the polishing process is maintaining the oxide removal rate constant across the top surface of the wafer as well as maintaining a constant oxide removal rate from one wafer to the next, when wafers are processed in succession. One known method of adjusting the oxide removal rate is by reconditioning the surface state of the polishing pad. This reconditioning process is known in the semiconductor industry as "dressing". Dressing consists of abrading the surface of the polishing pad with a grit-type instrument, much like a rasp having a diamond abrasive, between the polishing of successive wafers or successive groups of wafers. This dressing removes the glazed, hardened surface on the polishing pad and reconditions its polishing surface thereby maintaining a relatively constant removal rate from wafer to wafer. Without such dressing, or in the alternative, without repeatedly changing the polishing pad, the oxide removal rate would continue to degrade as more wafers are polished, since the surface roughness tends to decrease and such roughness determines, in large part, the overall abrasiveness of the polishing pad and slurry. The polishing pad itself, however, provides no significant abrasive effect without the use of the abrasive slurry even when the polishing pad is fully conditioned.

Prior dressing techniques do not provide trouble free process control for producing device patterns. Oxide removal rate is not constant between wafer and thus, causes a problem that the process margin in fabricating semiconductor devices is reduced, so as to lower production yield.

SUMMARY OF THE INVENTION

It is therefore a primary object of the present invention to provide a polishing device that can improve the uniformity and planarity of the plane of the surface of a wafer being polished.

According to one aspect of the present invention, there is provided in a polishing device including a rotatable polishing plate having an upper surface on which a polishing pad is attached, a plurality of rotatable wafer support spindles, each having a lower surface opposed to an upper surface of the polishing pad on the polishing plate, for holding a wafer to be polished on the lower surface and pressurizing means for applying a polishing pressure to the plurality of rotatable wafer support spindles, whereby the wafers held by the support spindles are rotatably pressed against the rotating upper surface of the polishing pad under the polishing pressure applied from the pressurizing means to perform polishing of the wafer(s); the improvement wherein the plurality of rotatable wafer support spindles are provided with an annular dressing wheel that is coaxial to and encircling the wafer supporting spindle.

It is an object of the present invention to provide a novel process and apparatus for dressing the polishing pad simultaneously during the CMP planarization process thereby preventing changes, such as glazing or pad mesh-clogging, with passage of time of the polishing cloth in the high pressure area by polishing the wafer and dressing the polishing pad at the same time.

It is another object of the present invention to provide the method and apparatus to consolidate wafer polishing and pad dressing during the CMP process to make room for multiple CMP spindles to increase machine throughput.

It is still another object of the present invention to provide the method capable of high yield in fabricating a semiconductor device.

It is an additional object of the present invention to provide the method, useful in a semiconductor device having large scale integration.

DESCRIPTION OF THE DRAWINGS

FIG. 1 is a schematic side view of a CMP apparatus according to the prior art.

FIG. 2 is a schematic top plan view showing a positional relationship of a polishing cloth, wafer polishing head, and a dressing head of the prior art.

FIG. 3 shows a bottom view of a coaxial polishing-dressing head assembly of the invention.

DETAILED DESCRIPTION OF THE PREFERRED EMBODIMENT

Figure 4:
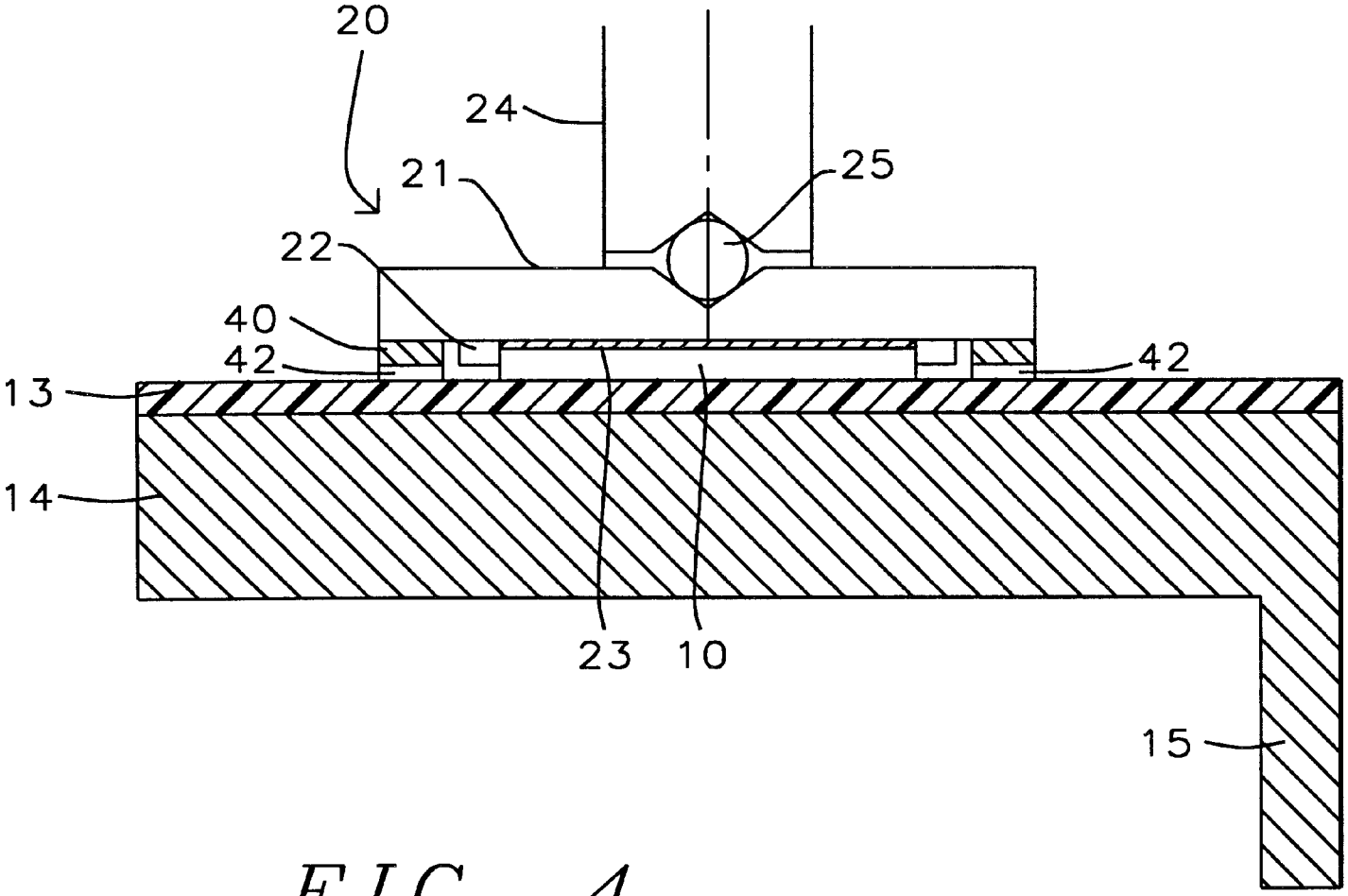
FIG. 4 is an schematic front section view of a CMP coaxial polishing-dressing head assembly of the invention.

Referring now to FIGS. 1 and 2 there is shown a schematic of a conventional polishing tool according to the prior art, illustrating the arrangement of a chemical mechanical polishing platen used for planarization polishing of a top surface topology of a semiconductor wafer.

A polishing pad 13 of a porous material is attached to the upper surface of a polishing platen 14. The polishing platen 14 is horizontally supported by a platen rotating shaft 15, and is rotationally driven through the platen rotating shaft 15 during the polishing operation.

A polishing head assembly 21 having a lower surface opposed to the upper surface of the polishing pad 13 on the polishing platen 14. The nesting recess 22 releasably holds a wafer 10 to be polished. An elastomeric material 23 in the nesting recess 22 having cohesive properties is used to attach the wafer 10 to the polishing head assembly 21. The polishing head assembly 21 is mounted to a rotating shaft 24 through a universal joint 25 and is driven through the rotating shaft 24

A nozzle 26 for dispensing a polishing slurry 27 is provided in the vicinity of the polishing head assembly 21. The polishing slurry supply system 28 onto the polishing pad 13 surface.

Initially, as part of a CMP polishing process, a polishing pad may be dressed (reconditioned) by a dressing wheel 30. Dressing alters the state of a polishing pad's surface. During polishing, slurry is pressed into the pad's surface by the pressure applied to the coaxial polishing-dressing head assembly 21 and with time will glaze into a hard film. Glazing precludes polishing and must be removed by reconditioning the top surface of the polishing pad 13 using a dressing wheel 30. A CMP tool polishes a wafer 10 which is positioned face down and in firm contact, under pressure, with a rotating polishing pad 13 which is mounted to a rigid platen 14. The wafer is also rotated either about an axis coincident with its own center or offset from its own center, but not coincident with the axis of rotation of the polishing pad 13. An abrasive polishing slurry 27 is dispensed to the pad surface through a nozel 26. As a result of the rotating contact and abrasion between the polishing pad 13 and of a top layer of the wafer 10, oxide on the wafers top layer is removed thereby planarizing the wafer. The rate of removal is closely proportional to the pressure applied to the wafer 10. Additionally, the rate of removal depends upon the topography of the top layer of wafer 10, as higher features (extending further from the wafer surface) are removed faster than lower features, since the higher features are subject to greater pressure. Because of this, glazing on the polishing pad does not occur uniformly, nor does the oxide removal rate on a wafer. One known method of adjusting the oxide removal rate is by altering the surface state of the polishing pad 13. This alteration or reconditioning is known in the semiconductor industry as "dressing". Such dressing consists of scraping the surface of the polishing pad with an abrading tool, between the polishing of successive wafers or successive groups of wafers. This abrading removes the glazing and reconditions the polishning surface to somewhat help maintain a relatively constant removal rate from wafer to wafer. Without such dressing, or in the alternative, without repeatedly changing the polishing pad 13, the oxide removal rate would continue to fall as more wafers are polished, since the surface roughness tends to decrease and such roughness determines, in large part, the overall abrasiveness of the polishing pad 13 and slurry 27.

FIGS. 1 and 2 illustrate a type of dressing wheel 30 of the prior art. The dressing wheel rotates under a controlled pressure and about its central axis to cover the annular track width generated by the wafer polishing. This operation is usually done between polishing of successive wafers.

The operation of the prior art polishing tool will now be described.

The semiconductor wafer 10 is attached through the cohesiveness of the elastomeric material 23 to the surface of the nesting recess 22. During polishing, the polishing platen 14 and the polishing head assembly 21 are rotationally driven through the rotating shafts 15 and 24 by driving means (not shown). The polishing slurry 27 is supplied from the polishing slurry supply system 28 through the nozzle 26 onto the polishing pad 13. The wafer 10 held by the polishing head assembly 21 is rotated and pressed against a rotating polishing pad 13 surface under a controlled polishing pressure applied from pressurizing means (not shown). The polished surface of the wafer 10 is polished by the combination of a chemical polishing slurry 27 and a mechanical granular silica contained in the polishing slurry. At the completion of the CWM planarization of the wafer 10, and during the wafer handling sequence, the polishing pad 13 is reconditioned to help restore its oxide removal rate.

There will now be described in detail with reference to the drawings some preferred embodiments of the present invention applied to a chemical mechanical polishing tool for planarizing of a semiconductor wafer. In the following description of the preferred embodiments, the same reference numerals as those in the prior art denote similar parts for convenience of illustration, and the description thereof will be omitted to avoid repetition.

Referring now to FIGS. 3, 4, 5, and 6. FIG. 3 and 4 illustrate a coaxial polishing-dressing head assembly 20 of a semiconductor wafer 10 by a chemical-mechanical polishing method comprising a polishing platen 14 having an upper surface on which a polishing pad 13 is affixed, the polishing platen 14 being rotated in one direction along a central axis thereof. A coaxial polishing-dressing head assembly 20 having a lower nesting surface 22 opposed to an upper surface of the polishing pad 13 on the polishing platen 14, the nesting surface. An elastomeric material 23 in the nesting recess 22 having cohesive properties is used to attach the wafer 10 to the polishing head assembly 21 releasably holding a wafer 10 to be polished. An annular dressing ring 40 is removably attached and coaxially mounted to the lower surface of the polishing head assembly 21 encircling the nested wafer 10. The coaxial polishing-dressing head assembly rotates along a central axis thereof, pressing the semiconductor wafer on a radial portion of the rotating polishing pad. The pressure is controlled for applying a, process established, polishing and dressing pressure to the coaxial polishing-dressing head assemblies, whereby the wafer and dressing ring on the lower surface of the coaxial polishing-dressing head assemblies are pressed against the upper surface of the polishing pad.

Figure 5:
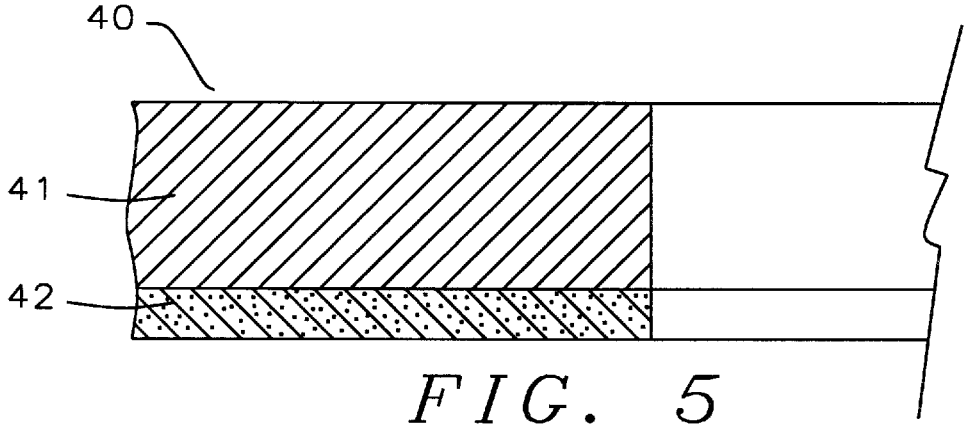
FIG. 5 is an enlarged schematic sectional view of the dressing ring of the invention.

FIG. 5 illustrates an enlarged sectional view of the annular dressing ring 40 having a metal support ring 40 for removably mounting to the polishing assembly 21. A dressing ring 42 comprising inclusions of pulverized diamond sintered in a ceramic base with a glass frit binder.

Figure 6:
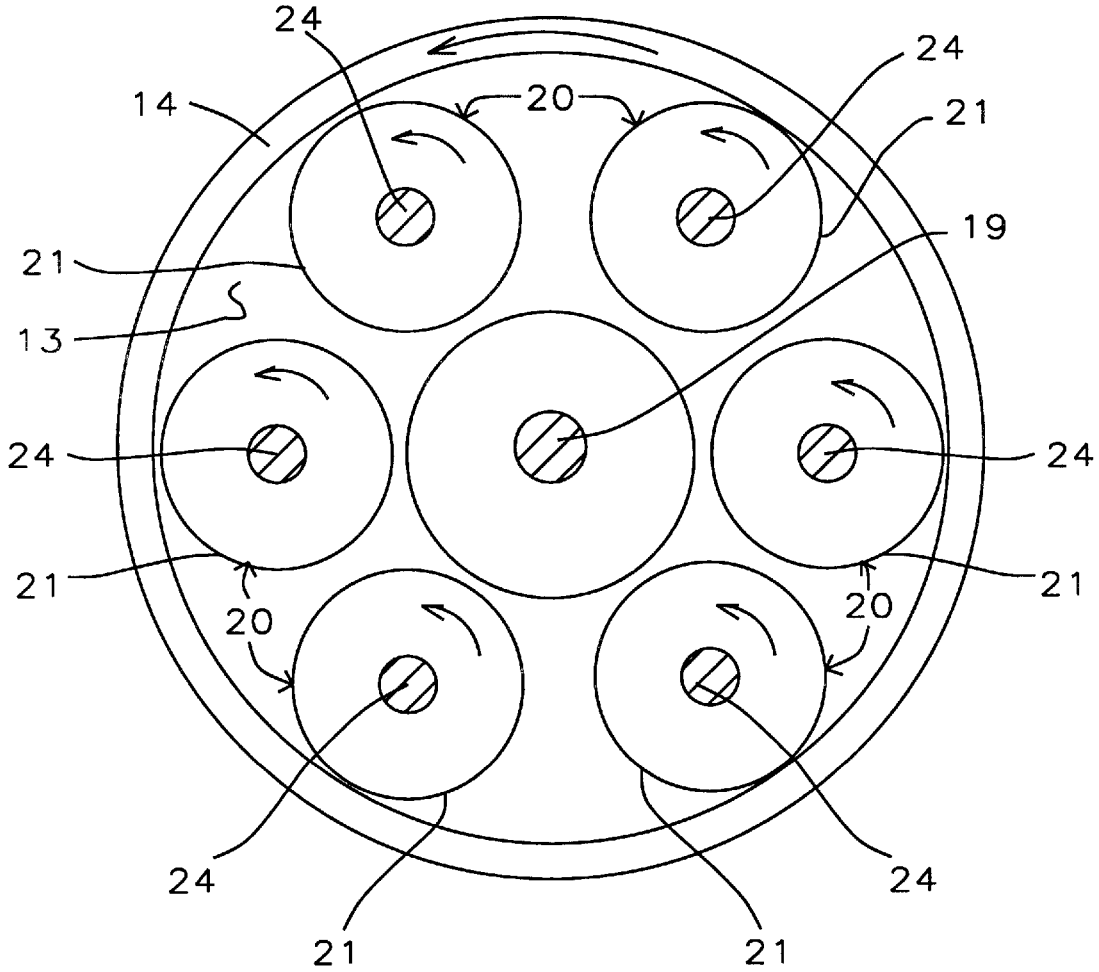
FIG. 6 is a schematic plan view showing a configuration of a polishing cloth, a multiple coaxial polishing-dressing head assemblies of the invention.

FIG. 6 illustrates a plan view showing a plurality of coaxial polishing-dressing head assemblies for effective space utilization on a single CMP tool. By combining pad dressing on the same spindle as wafer polishing, many advantages become evident. Increases machine space availability, increases machine throughput, improves polishing uniformity and process stability while simplifying the machine structure and improving maintainability.

While the invention has been particularly shown and described with reference to the preferred embodiments thereof, it will be understood by those skilled in the art that various changes in form and details may be made without departing from the spirit and scope of the invention.

What is claimed is:

1. A method for simultaneously polishing a plurality of substrates using coaxial polishing-dressing devices, said method comprising the steps of:

providing a rotatable platen having a top surface with a polishing pad mounted thereon;

preparing said polishing pad with a polishing compound;

providing a plurality of coaxial polishing-dressing head devices, each attached to a common rotatable support spindle said coaxial polishing-dressing head devices having a lower surface opposed to an upper surface of the polishing pad on said polishing platen, said coaxial polishing-dressing head devices having a recessed nesting means f releasably holding a substrate to be polished, said nesting means including an elastomeric surface said nesting means rotating along a central axis thereof;

said polishing-dressing head devices providing plurality of annular dressing rings for dressing said polishing pad area, said annular dressing rings are positioned coaxially encircling each nested substrate;

providing a controlled means to said rotatable support spindle for applying a process established polishing and dressing pressure to said coaxial polishing-dressing head devices, whereby the substrate and dressing ring on the lower surface of said coaxial polishing-dressing head devices are rotatable pressed against the upper surface of the polishing pad.

2. The method according to claim 1 wherein coaxially combining said dressing ring with said substrate, simultaneously polishes said substrate and dresses said polishing pad.

3. The method according to claim 1 wherein said annular dressing ring comprises an annular support member on which a suitable dressing material is bonded.

4. The method according to claim 1 wherein said annular dressing ring foundation is made of a ceramic.

5. The method according to claim 1 wherein said annular dressing ring ceramic foundation includes a glass frit binder.

6. The method according to claim 1 wherein said annular dressing ring ceramic foundation has inclusions of sintered diamond abrasives.

7. The method according to claim wherein coaxially combining said annular dressing ring on said coaxial polishing-head devices on a CMP machine eliminates the need of a separate dressing station.

8. The method according to claim 1 wherein eliminating the need of a separate dressing station saves machine space allowing additional nesting support head stations for increasing machine throughput.

9. The method according to claim 1 wherein coaxially combining said annular dressing ring improves polishing uniformity and process stability.

10. The method according to claim 1 wherein coaxially combining said annular dressing ring with said substrate polishing head simplifies the structure of the machine while improving maintainablilty.

* * * * *